US006725903B2

(12) United States Patent
Laurino

(10) Patent No.: US 6,725,903 B2
(45) Date of Patent: Apr. 27, 2004

(54) AUTOMATED CASTING SYSTEM

(75) Inventor: Attilio Laurino, Piossasco (IT)

(73) Assignee: Fata Aluminium S.p.A., Turin (IT)

( * ) Notice: Subject to any disclaimer, the term of this patent is extended or adjusted under 35 U.S.C. 154(b) by 0 days.

(21) Appl. No.: 10/112,856

(22) Filed: Apr. 2, 2002

(65) Prior Publication Data

US 2003/0183361 A1 Oct. 2, 2003

(30) Foreign Application Priority Data

Apr. 3, 2001 (IT) ..... TO2001A0318

(51) Int. Cl.[7] ..... B22D 47/00
(52) U.S. Cl. ..... 164/323
(58) Field of Search ..... 164/322, 323, 164/324, 325, 326, 327, 328, 329, 330, 331, 129, 130

(56) References Cited

U.S. PATENT DOCUMENTS 4,589,467 A * 5/1986 Hunter ..... 164/326
4,747,444 A * 5/1988 Wasem et al. ..... 164/457
5,069,267 A * 12/1991 Larsen ..... 164/155.1
5,701,945 A * 12/1997 McKibben et al. ..... 164/130
5,778,962 A * 7/1998 Garza-Ondarza et al. ... 164/130
6,073,678 A * 6/2000 Garza-Ondarza et al. ... 164/130

* cited by examiner

*Primary Examiner*—M. Alexandra Elve
*Assistant Examiner*—Kevin P. Kerns
(74) *Attorney, Agent, or Firm*—Sughrue Mion, PLLC

(57) ABSTRACT

An automated casting system includes: a plurality of casting stations, a molten-metal collection station with at least one furnace containing molten metal, an automated casting apparatus extending between the casting stations and the collection station and provided with a robotic device for moving a casting ladle in a cyclic and controlled manner in order, in each cycle, to collect molten metal from the collection station and to pour it out in a station selected from the casting stations, an automatic casting-transfer apparatus extending between the casting stations and a discharge station and provided with a robotic device for moving, in a controlled manner coordinated with the casting apparatus, grippers for gripping and transferring the castings from one of the casting stations to the discharge station.

10 Claims, 10 Drawing Sheets

45
41
X41
42
44a
44b
X45
45
41a
46
X46
46
47a
44c
43
47b
X47
X49
49
48
49a
49b
X48

AUTOMATED CASTING SYSTEM

BACKGROUND OF THE INVENTION

The present invention relates to a system for the automated gravity casting of workpieces, in particular but not exclusively for the production of aluminium alloy workpieces.

Currently, gravity casting systems comprise automated casting machines having openable moulds into which molten metal is cast and from which the solidified castings are extracted.

Automation generally leads to the production of systems which are "dedicated" to the specific type of casting to be produced, to the extent that it is not possible to produce castings of different types without substantial modification of the system. The term "different" is intended to indicate not only castings of different shapes but of the same type, but also and above all, castings of different types.

SUMMARY OF THE INVENTION

The main object of the invention is to provide a casting system with a high output and with a high degree of automation, which can reduce production costs and the number of rejects.

Another object of the invention is to provide a casting system which permits improved control of the production process.

Another object of the invention is to provide a casting system having characteristics of flexibility which enable it to be adapted easily and quickly to the production of castings of different types, without precluding the possibility of also collecting the castings from the casting machines manually.

A further object of the invention is to provide a casting system which can make use of the advantages resulting from automation even in cases in which one or more of the devices of the system are temporarily deactivated for maintenance, owing to faults, or for off-line production.

These and other objects and advantages which will be understood further from the following are achieved, according to the invention, by a system having the characteristics defined in the appended claims.

BRIEF DESCRIPTION OF THE DRAWINGS

A preferred but non-limiting embodiment of a system according to the present invention will now be described with reference to the appended drawings, in which.

DETAILED DESCRIPTION OF THE INVENTION

Figure 1:
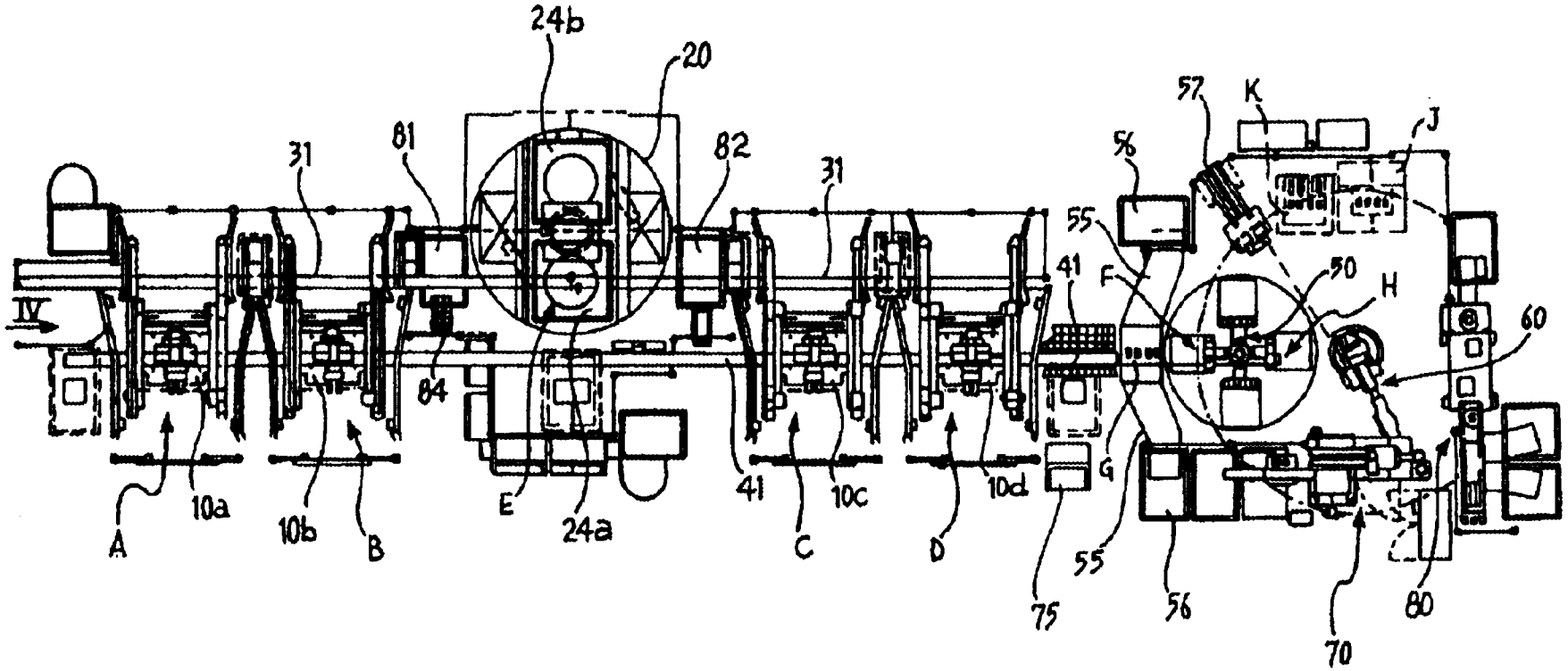
FIG. 1 is a general plan view of a system according to the present invention.

With reference initially to FIG. 1, a casting system according to the invention comprises a plurality of casting stations A, B, C, D; in this embodiment, there are four casting stations, aligned along an axis defined herein as a longitudinal axis and arranged side by side in pairs.

Figure 10:
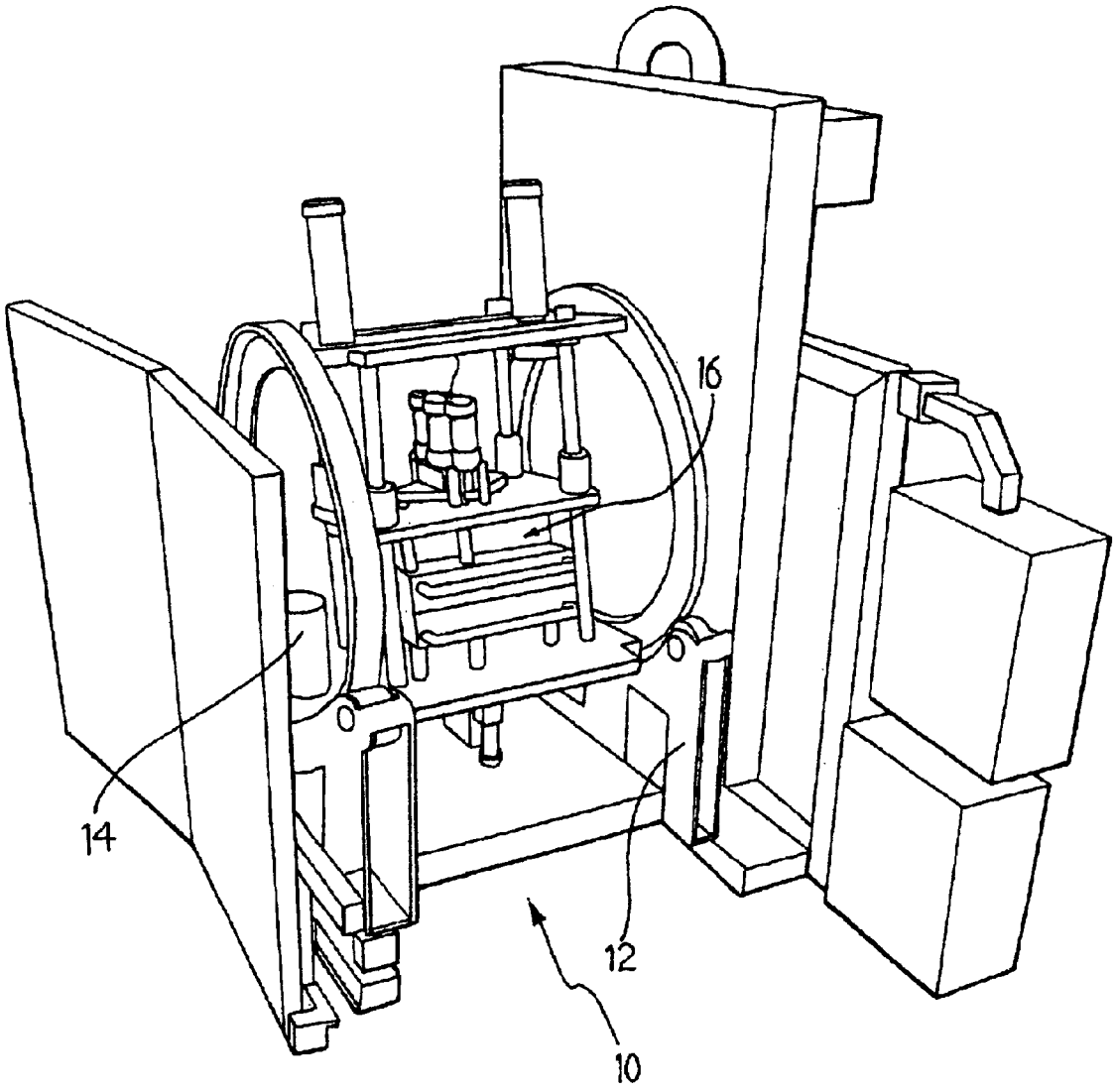
FIG. 10 is a schematic, perspective view of a casting machine of known type suitable for use in the system of the present invention.

In each casting station, there is a casting machine 10*a*, 10*b*, 10*c*, 10*d*, for example, of the type shown separately in FIG. 10. A casting machine of this type, which is known per se, is not relevant for the purposes of an understanding of the invention and will not therefore be described in detail herein. It will suffice to note here that the casting machine 10 of FIG. 10 has a framework 12 with an electric motor 14 which periodically brings about tilting of an openable mould 16 in a vertical plane. During each casting cycle, the mould receives a certain amount of molten metal and is rotated through about 90° about a horizontal axis in accordance with a predetermined casting regime in order to fill the cavity of the mould. When solidification has taken place, the mould is opened and the casting is extracted and taken away, as will be described further below.

Figure 8:
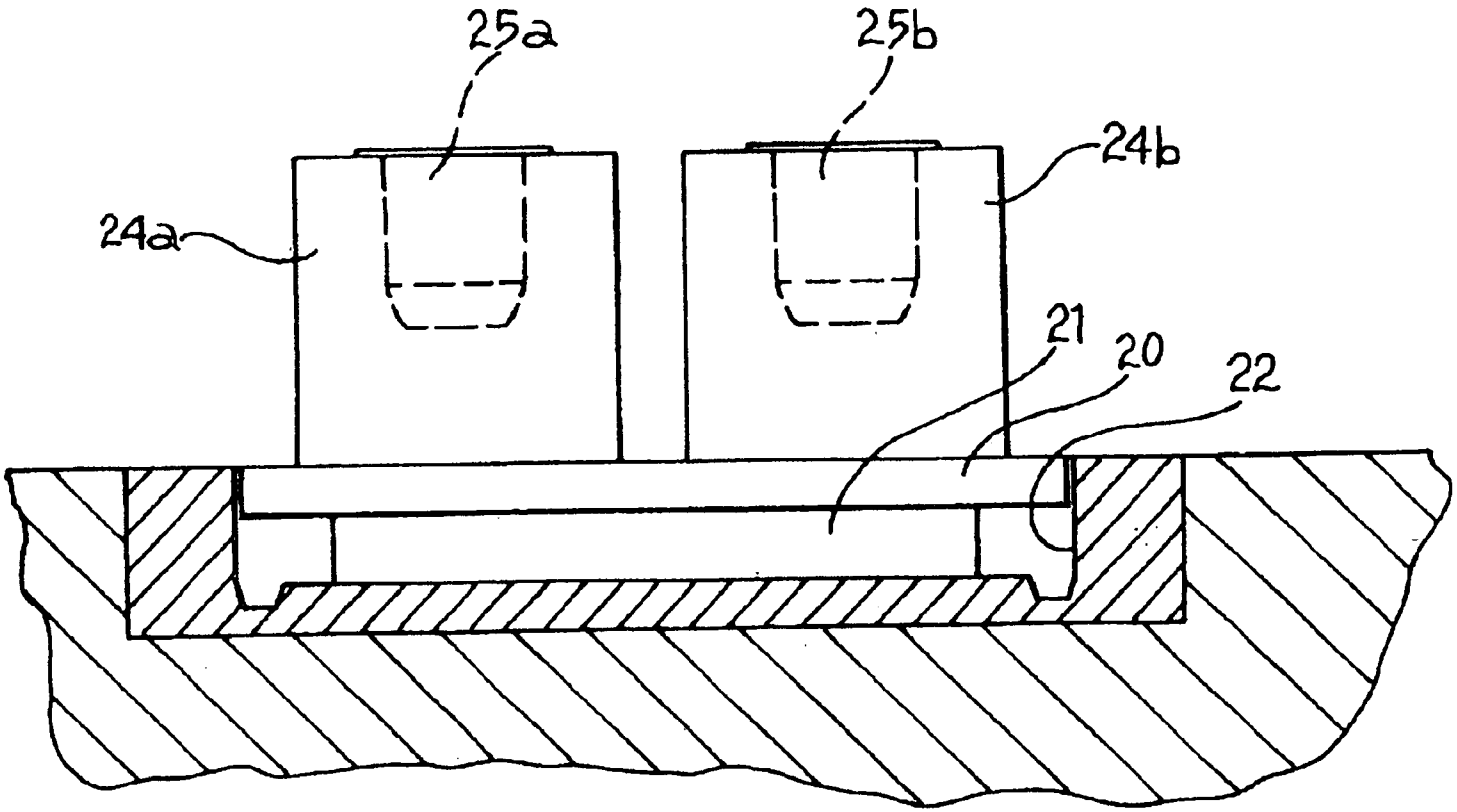
FIG. 8 is a schematic vertical section through a rotary table provided with a pair of furnaces.

A table 20 disposed between the pairs of casting stations A, B and C, D is rotatable about a vertical axis by means of a geared motor (not shown for simplicity). As is also shown in FIG. 8, the table 20 is mounted on a horizontal bearing 21 fixed in the floor in a pit 22 formed to keep the table flush with the floor.

Figure 2:
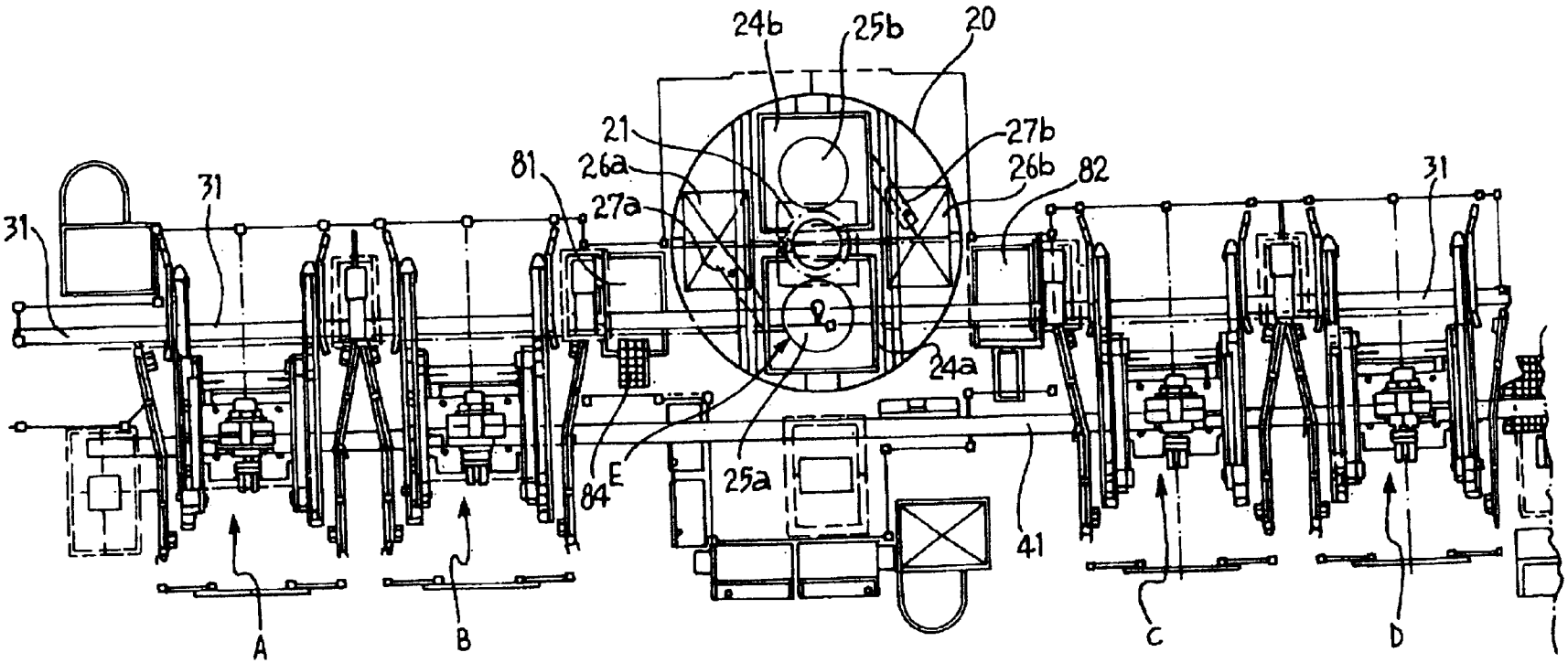
FIG. 2 is a plan view showing a part of the system of FIG. 1, on an enlarged scale.

The table is equipped with a pair of furnaces 24*a*, 24*b* which are diametrally opposed with respect to the vertical central axis of the table so as to be arranged alternately in a loading position such as that occupied by the furnace 24*b* in FIGS. 1 and 2, and a working or collection position E which faces in the direction of the casting positions A–D and is occupied by the furnace 24*a* in these drawings. The furnaces 24*a*, 24*b* are preferably of the electrical type with single-basin crucibles 25*a*, 25*b*. In order to be filled, the furnaces are removed alternately and periodically from the table, from the loading position, transported to a remote filling station (not shown) and, once full, are replaced in the loading position on the table 20. As will be described further below, this operation can be performed whilst molten metal is collected from the crucible of the furnace in the working position, without interrupting the casting cycles. Two ingot moulds 26*a*, 26*b* are provided beneath the table 20, with ducts 27*a*, 27*b* for directing the molten metal in the event of breakage of either of the crucibles. The electrical power supply reaches the furnaces from above, through the center of the table.

As shown in FIGS. 1, 2, 4 and 5, the system includes an automated casting apparatus, generally indicated 30, in the form of a Cartesian robot. The apparatus 30 transfers liquid metal from the furnace which is in the collection position E on the rotary table 20 to the individual casting machines 10*a*–10*d*.

The casting apparatus 30 comprises a straight horizontal guide 31 which extends above and in the vicinity of the casting stations A–D and of the collection station E of the furnace which is disposed on the same side as the casting stations. A carriage 32 can slide along the guide 31 and carries a robotic casting device, generally indicated 33. Four drive units, generally and schematically indicated 34, are mounted on the carriage 32. A first drive unit brings about the horizontal translational movement of the carriage along the guide 31. A second drive unit brings about vertical movement of a vertical rod 35 along a vertical guide 36 fixed to the carriage 32. An arm 37 articulated to the lower end of the rod 35 is pivoted about a longitudinal horizontal axis $x_1$ by a third drive unit. A casting ladle 38 is hinged on the lower end of the arm 37 and in turn can be tilted about a longitudinal horizontal axis $x_2$ by means of a fourth drive unit.

A pair of electrodes (not shown), the function of which will be explained below, is mounted on the casting ladle.

The casting apparatus 30 thus has a range of operation which enables liquid metal to be collected by the ladle 38 from the collection station E of one of the crucibles and to be poured into any one of the moulds of the casting machines 10*a*–10*d*.

With reference now to FIGS. 1, 2, 6 and 7 in particular, the system includes automated apparatus in the form of a Cartesian robot for transferring the castings from the casting positions A–D to a discharge station F (visible in FIGS. 1, 3 and 6) from which the castings are collected and removed in order to be subjected to further processing, or discarded if they are defective.

The transfer apparatus, generally indicated at 40, comprises a straight horizontal guide 41 substantially parallel to the guide 31 of the casting apparatus 30. The guide 41 extends above the casting stations A–D and the discharge station F. A carriage 42 can slide along the guide 41 and carries a robotic gripping device, generally indicated 43, for collecting the castings from the machines 10*a*–10*d*.

Figure 7:
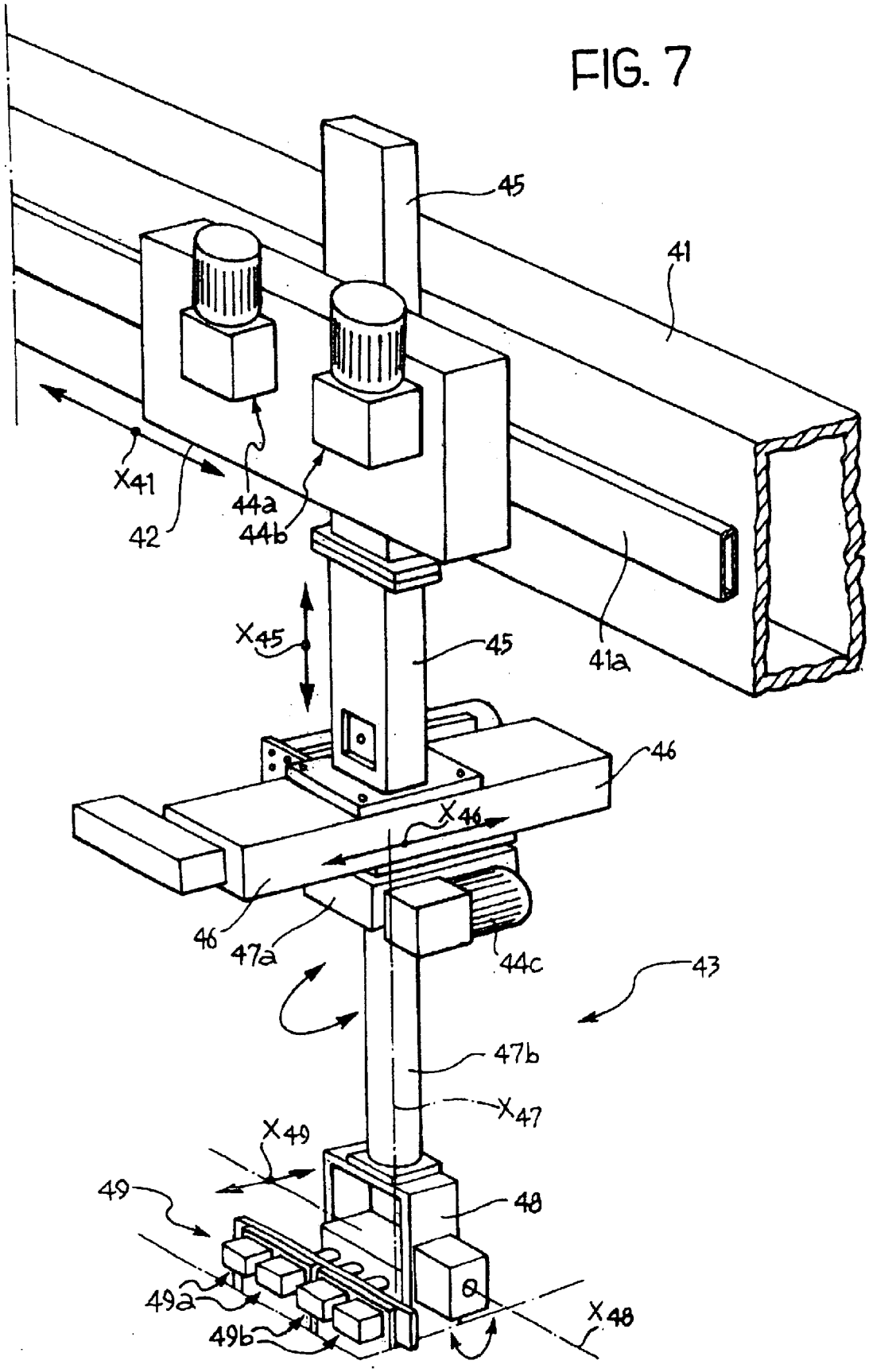
FIG. 7 is a schematic, perspective view showing, on an enlarged scale, a robotic casting-gripping device forming part of the transfer apparatus of FIG. 6.

In the preferred embodiment shown in greater detail in FIG. 7, the robotic gripping device 43 is configured for performing combined rotational and translational movements along and about seven geometrical axes, as specified below.

The gripping device 43 is suspended on the carriage 42 which can slide longitudinally along a track 41*a* of the support guide 41. This translational movement along an axis defined herein as the first geometrical axis (a horizontal longitudinal axis X41) is performed by means of a geared electric motor 44*a* mounted on the carriage 42.

A second geared electric motor 44*b*, also mounted on the carriage 42, brings about vertical movement of a rod 45 which is guided vertically by the carriage 42 along a second, vertical geometrical axis X45. The rod 45 carries, at its lower end, a transverse horizontal guide 46 along which a slide 47*a* driven by a third geared electric motor 44*c* can slide along a third, horizontal and transverse geometrical axis X46.

The slide 47*a* supports rotatably the upper end of a vertical shaft 47*b*. The slide 47*a* is moved along the third axis X46 by the geared electric motor 44*c*, whereas the shaft 47*b* is rotated about its own vertical axis X47 pneumatically. A box-like support 48 is fixed to the lower end of the shaft 47*b* and a multi-gripper gripping unit 49 is fixed thereto. The unit 49 is connected rotatably to the support 48 in order to rotate through ±90° about a fifth, horizontal geometrical axis X48 under the effect of a pneumatic drive.

In the preferred embodiment, two pairs of grippers, that is, a left-hand pair 49*a* and a right-hand pair 49*b*, are provided and are operated pneumatically in order to slide radially relative to the axis X48 along a sixth geometrical axis X49. Each gripper is operated pneumatically in order to close and open along a respective seventh axis of movement (not shown for simplicity) in order for the grippers to grip a corresponding number of castings. The extension movement of the grippers along the axis X49 is brought about pneumatically, whereas movement in the opposite direction takes place freely to allow the grippers to retract once they have been closed onto the castings during the extraction of the castings from the casting mould, under the thrust exerted along the axis X49 by an ejector unit (not shown) mounted on the casting mould.

The radial withdrawal movement of the grippers along the axis X49, which may, for example, be permitted by the opening of a discharge valve of the pneumatic actuator (not shown) advantageously allows the grippers to perform short travel movements in a direction substantially parallel to the transverse axis X46 without the geared electric motor 44*c* being operated.

The geared motors 44*a*, 44*b* and 44*c* which bring about the longitudinal, vertical and transverse translational movements along the axes X41, X45 and X46 are numerically controlled.

In the embodiment shown in the drawings, the gripping unit 49 is divided into two units in order to grip four castings simultaneously. As evident, this choice, as well as the above-described configuration of the members making up the robotic device 43, constitute choices which are preferential in some conditions of use but are certainly not essential for the purposes of the implementation of the invention. Similar remarks apply to the construction of the above-described robotic casting device 33.

The gripping device 43 can thus slide along the vertical axis of each of the casting machines in order to collect the castings from them, with the mould open in a vertical plane. By virtue of the collection which is brought about by the gripping device 43 from above, it is also possible to collect the castings manually from the rear of one of the casting machines by opening the mould in a horizontal plane and continuing to use the transfer apparatus 40 for the remaining machines, without interfering with the travel of the gripping device 43. The system preferably has horizontal surfaces or gratings (not shown) for protecting the area in which operators may move around each of the casting machines.

The system is provided with detectors (not shown), for example, optical-fibre detectors for checking the quality of the castings, in particular, the presence of cast material at predetermined points. These quality detectors may be positioned at fixed points of the system or may be mounted on the carriage 42, according to the type of detector selected and on their dimensions. If optical-fibre detectors or sensors of another type are selected, they may advantageously be mounted on the carriage 42, in accordance with the shape of the castings to be removed from the casting machines, the number of detectors corresponding to the number of castings that can be collected in each cycle. In the embodiment shown in the drawings, in which the gripper unit 49 has four grippers for gripping a corresponding number of castings, four detectors may be provided for checking the quality of each casting, giving a total of sixteen. If, on the other hand, television-camera detectors which compare a detected image of the casting with a stored sample are selected, these detectors may be installed at fixed points of the system or, if the dimensions of the television cameras permit, they may be mounted on the carriage 42 or on the robotic device 43. The operation of the gripping device 43 is described further below.

The signals supplied by the detectors are transmitted to a processing unit which, if it receives all (sixteen) signals emitted by the detectors, imparts to the transfer apparatus 40 a command to deposit the castings in the discharge station F or, if it does not receive at least one of the checking signals from the detectors, controls the apparatus 40 in a manner such that the castings are deposited in a reject station G in order to be conveyed into bins 56 by means of chutes 55.

A blower device (not shown) is also mounted on the gripper unit 49 for blowing in air-jets to clean the grippers. Individual air-jets are preferably provided for each gripper.

Figure 3:
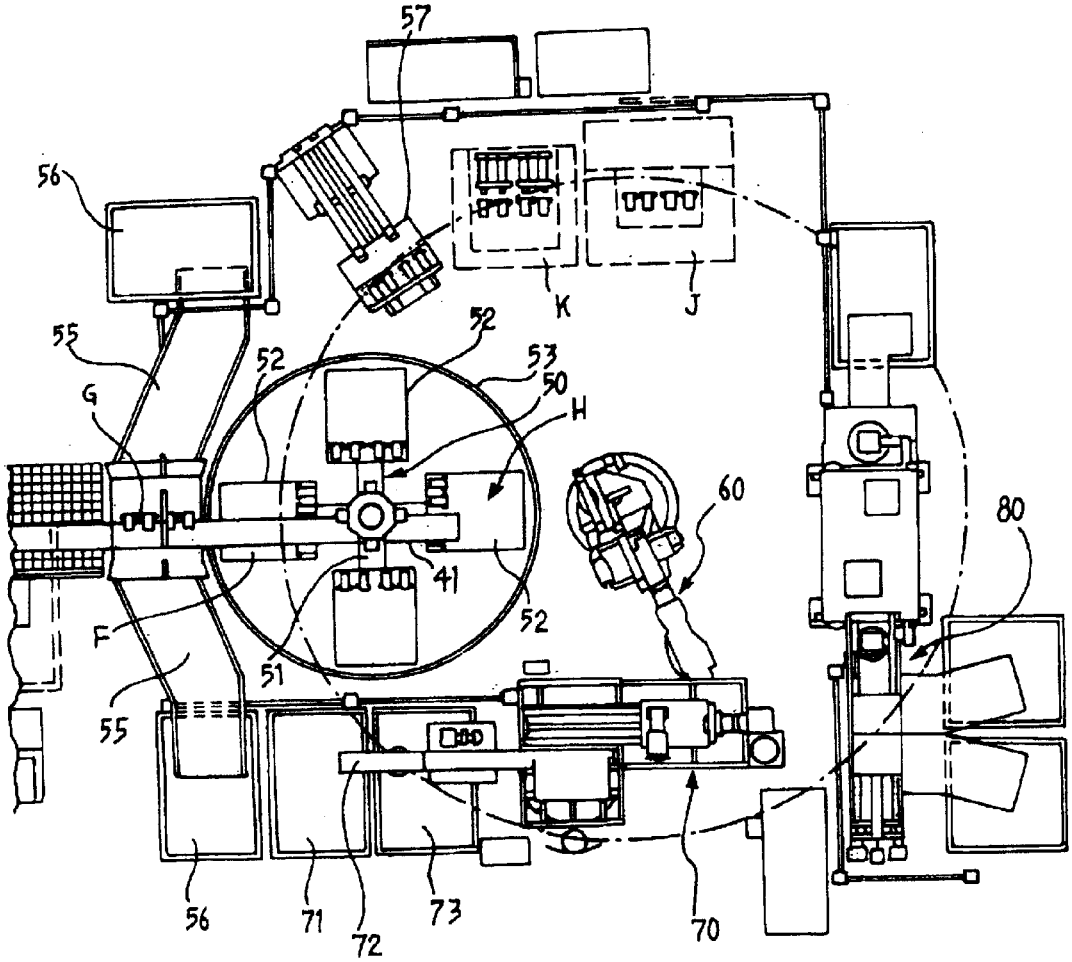
FIG. 3 is a plan view showing another part of the system of FIG. 1, on an enlarged scale.
Figure 4:
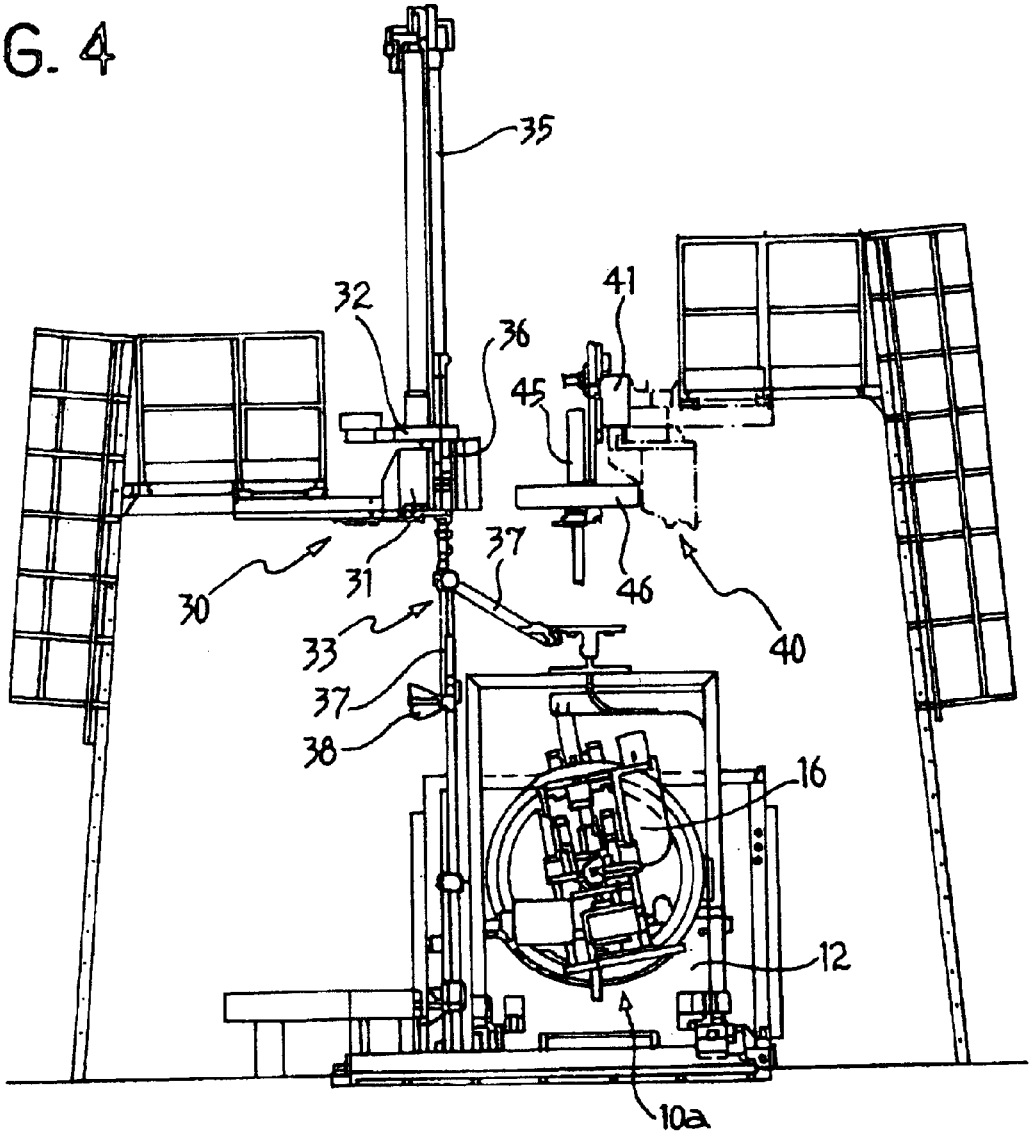
FIG. 4 is a side elevational view taken on the arrow IV of FIG. 1.
Figure 5:
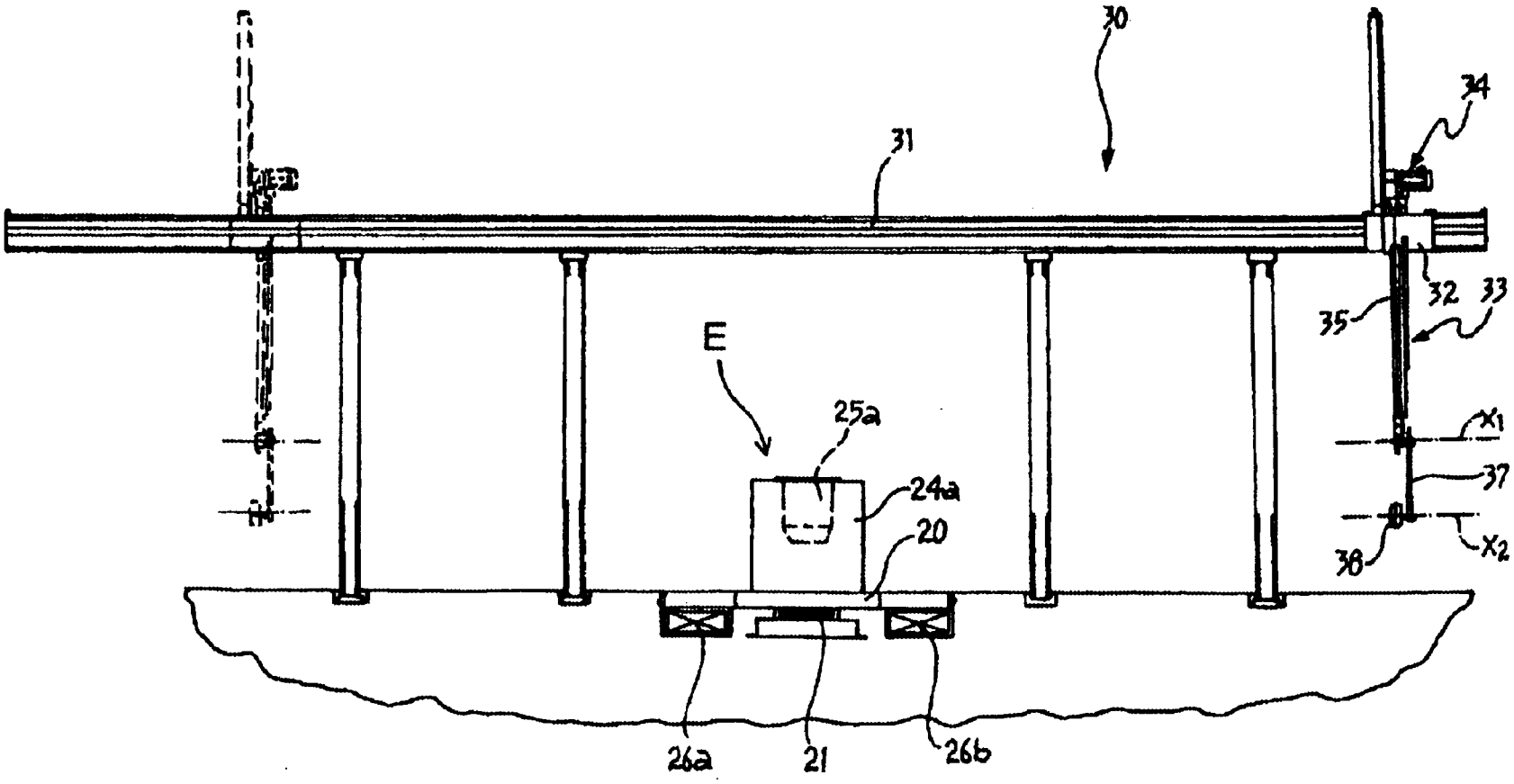
FIG. 5 is a front elevational view of robotic casting apparatus.
Figure 6:
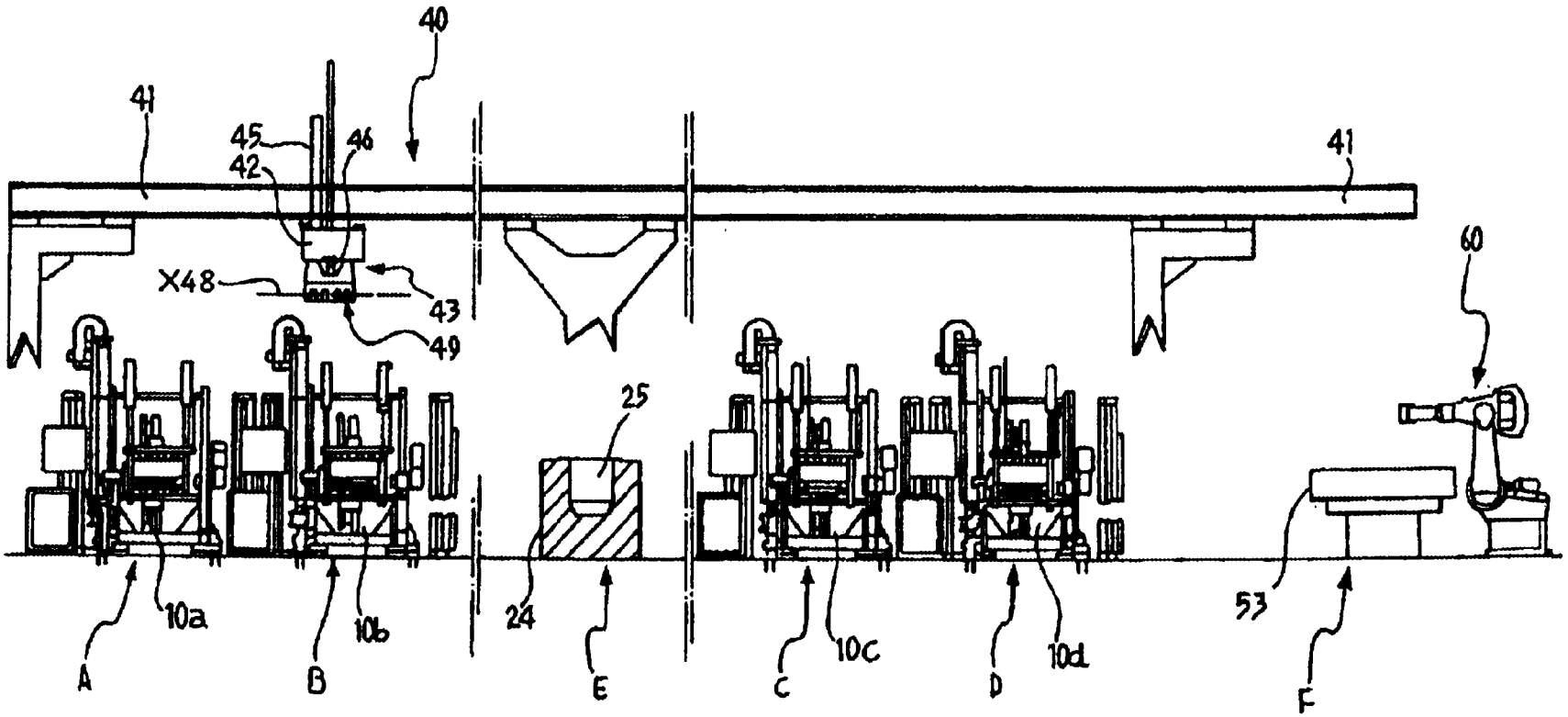
FIG. 6 is a front elevational view of casting-transfer apparatus.

With reference now to FIG. 3, the discharge station F is disposed on a turntable 50 rotatable about a vertical axis and provided with four horizontal arms 51 each of which has, at its radially outer end, a plate 52 with housings for housing the castings deposited by the gripper unit 49.

The turntable 50 is in a cooling tank 53 containing a liquid coolant bath at controlled temperature. The turntable is rotated through 90° in each cycle, in synchronism with the deposition of the castings on its plate 52, which is arranged cyclically in the discharge station F. The cooled castings are brought by the turntable 50 to a position H from which they are collected by an anthropomorphic robot 60 with six axes which deposits the castings in a sawing machine 70 of known type which cuts off the sprue. The sprue cut off is conveyed into a bin 71 by a mesh conveyor belt 72 which allows the chips to fall into a bin 73.

The anthropomorphic robot 60 transfers the castings from the sawing machine 70 to a press 80 in which deburring, broaching and pressing operations are performed. In the preferred embodiment shown in FIG. 3, the radius of operation of the anthropomorphic robot 60 also includes a perforation station J and a stamping station K.

The movements of each of the sets of apparatus described above are brought about as a result of commands imparted by specific processing units for each set of apparatus, so that it is also possible to use only some of the apparatus of the system automatically, whilst other apparatus may be shut down for maintenance operations. All of the processing units which control the various devices communicate with one another directly and/or by means of a central processing unit, typically a PLC (programmable logic controller) or a master console 75 which supervises the operation of the system as a whole and hence also the operation of all of the motor/actuator units described herein.

Figure 9:
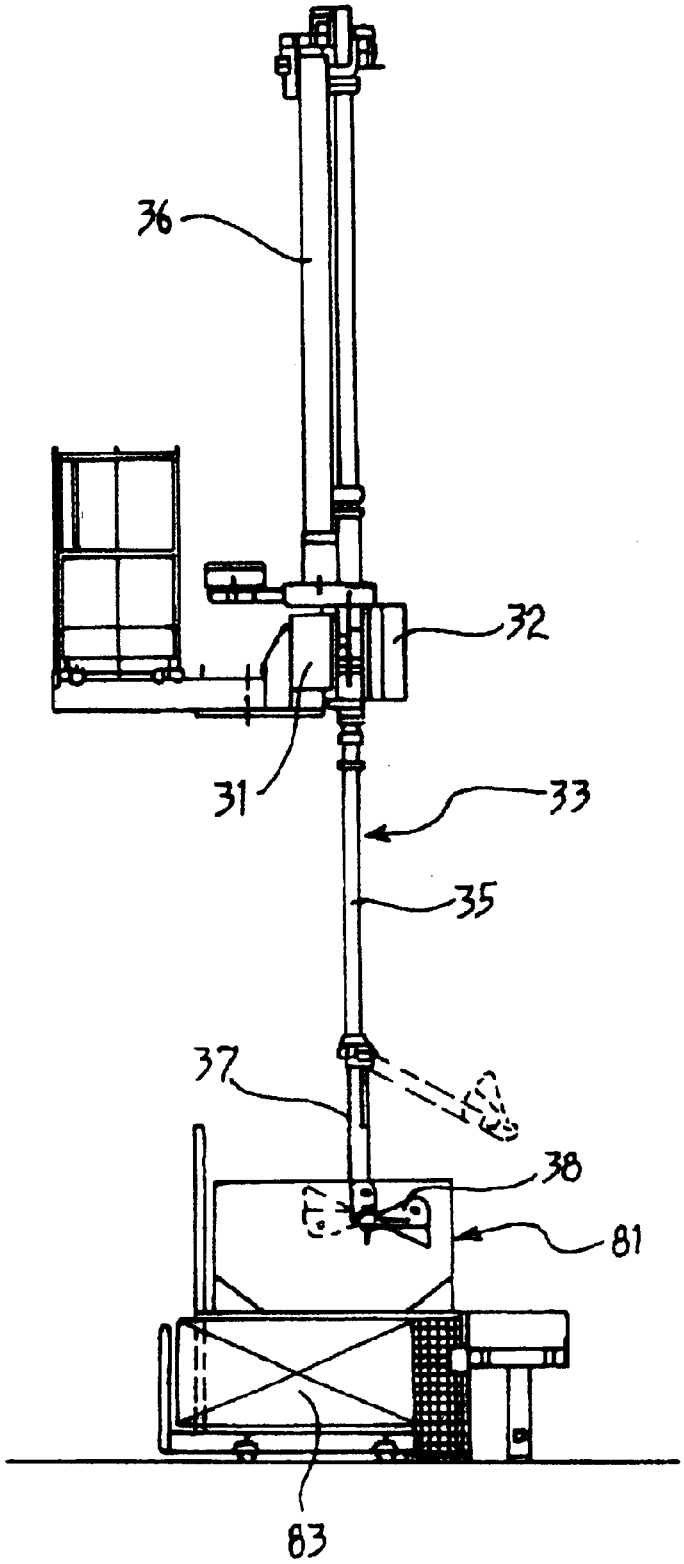
FIG. 9 is a schematic vertical section through a station for the cleaning of a casting ladle.

FIGS. 2 and 9 show two identical devices 81, 82 for cleaning the casting ladle by means of air jets which serve to detach from the concave surfaces of the ladle the metal-oxide skins which tend to adhere thereto. The cleaning devices 81, 82 advantageously have covers so that the skins detached from the ladle are prevented from being dispersed into the environment but are collected in a container 83.

A method of operation of the system according to the invention is as follows.

In order to perform a casting cycle, the robotic apparatus 30 is activated in order to bring the casting ladle above the crucible of the furnace which is in the collection station E (the furnace 24*a* in FIG. 2). The furnaces have maximum and minimum temperature sensors which are connected to the casting apparatus 30 and which give the consent for collection only if the temperature of the metal bath in the crucible in question is within a predetermined temperature "range". If collection is permitted, the robotic casting device 33 lowers the ladle 38 into the molten bath in controlled manner, slowing the movement of the ladle when it is close to the molten metal.

When the collection has been performed, the carriage 32 of the apparatus 30 brings the ladle to one of the casting stations A–D, in particular, to the station of the casting machine which is ready to receive the metal and which has requested the casting or indicated its availability for this purpose to the central processing unit.

By control of the members of the robotic casting device 33, the ladle pours the molten metal into the mouth of the mould and the casting machine performs its own cycle as described above.

The empty ladle is then brought into the cleaning device 81 or 82 closest to the machine just filled and is rotated about the horizontal axis $x_2$ to an inverted position in order to be cleaned by means of an air-jet which detaches the so-called "skin" from the ladle. To improve this operation, the ladle is preferably made of non-stick material, for example, ceramic material or is covered by a layer of paint with non-stick material, for example, ceramic material or is covered by a layer of paint with non-stick properties. The cleaned ladle is then returned to the crucible of the furnace which is in the collection station E, in order to perform a further collection.

The casting apparatus 30 automatically lowers the ladle to a level which is below that of the previous collection cycle by a height calculated in dependence on the capacity of the ladle. Each crucible has a level sensor which emits a crucible "empty" signal when the molten metal has fallen to a predetermined low level. When the processing unit which supervises the operation of the rotary table 20 receives this signal, this unit automatically brings about rotation of the table through 180° so as to present the other, full crucible 25*b* in the collection position, whilst the empty crucible 25*a* can be removed from the table and taken away to be refilled.

The rotation of the table 20 automatically resets the level at which the casting ladle is to be stopped during the immediately successive collection cycle. In any case, the electrodes disposed on the ladle provide for a signal to stop the downward movement of the ladle to be transmitted when they come into contact with the surface of the molten metal in the crucible.

In a particularly preferred embodiment, collection by the casting robot is permitted solely when all of the following conditions are fulfilled:

- the table has rotated to the correct position so that one of its furnaces is disposed in the collection position occupied by the furnace 24*a* in FIG. 2; this condition is ascertained by a proximity sensor associated with the rotary table 20;
- the crucible of the collection furnace is correctly positioned on the table 20; this condition is ascertained by position sensors or switches disposed on the rotary table 20 in the area supporting the crucibles,
- the cover of the furnace situated in the collection position is open; this condition may also be confirmed by a switch connected to the covers (not shown in the drawings) of the furnaces.

The automated transfer apparatus 40 takes the castings from the individual casting machines from time to time. When the castings have solidified, the mould of the casting machine is opened; the gripping-unit 49 is brought to the vicinity of the mould and grips the castings. Whilst the carriage 42 is moved along the guide 41, the optical-fibre detectors mounted on the carriage check the quality of the castings. If all of the positive quality signals are received by the processing unit connected to these detectors (in this example sixteen signals), the carriage 42 is brought over the discharge station F and the robotic device 43 is moved in order to deposit the castings on the plate 52 in the cooling tank 53. If, however, at least one positive quality signal does not reach the processing unit, which indicates a defective casting condition, the castings are deposited in the reject station G and are conveyed into the bins 56 by means of the chutes 55.

With regard to the movements performed by the gripping device 43, the horizontal translation of the carriage 42 along the guide 41 enables the gripping device 43 to be brought vertically into alignment with the various casting stations A–D and with the discharge and reject stations F and G. Vertical translation of the rod 45 enables the device 43 to be lowered and raised between the lowered position for collection from the stations A–D and the discharge and reject stations F and G and the raised, transportation position. Transverse translation along the guide 46 enables the collection position to be adjusted in dependence on the positions of the gripping regions of the castings on the casting machines.

Rotation about the vertical axis X47 enables the castings to be picked up selectively and alternatively, according to requirements, from either of the two half-moulds (left-hand or right-hand) on which the casting remains after the mould has been opened.

Rotation about the horizontal axis x48 enables vertically oriented castings to be collected from the casting machines and then deposited in horizontal positions in the discharge and reject stations F and G. Finally, radial translation along the axis X49 serves to facilitate the removal of the castings from the moulds.

Whereas the defective castings are rejected, the sound ones which are conveyed into the bins 56 can be removed manually from these bins in order to be sent back into the finishing cycle by being placed manually in a by-pass station 57 from which they can be picked up by the anthropomorphic robot 60.

In the discharge station F, the castings are cooled in the tank 53. The turntable 50 brings the cooled castings to the station H, from which they are picked up by the robot 60 in order to be transferred in succession to the sawing machine 70, to the press 80, and possibly to the perforation and stamping stations J and K.

As can be appreciated, the system according to the invention enables some of the operations (casting, transfer, final machining) to be performed automatically even when some of the apparatus is shut down for maintenance or due to faults.

Should one or more of the casting machines be inactive so that the casting apparatus has to wait for a waiting period which would lead to undesired cooling of the casting ladle, the ladle can be brought temporarily to a preheating station, schematically indicated 84.

Naturally, the principle of the invention remaining the same, the details of construction and forms of embodiment may be varied widely with respect to those described and illustrated, without thereby departing from the scope of the present invention as defined by the appended claims.

What is claimed is:

1. An automated casting system comprising:

a plurality of casting stations, a molten-metal collection station with at least one furnace containing molten metal, an automated casting apparatus extending between the casting stations and the collection station and provided with a robotic device for moving a casting ladle in a cyclic and controlled manner in order, in each cycle, to collect molten metal from the collection station and to pour it out in a station selected from the casting stations, and an automated casting-transfer apparatus, extending between the casting stations and at least one discharge station and provided with a robotic device for moving casting-gripping means, in a controlled manner coordinated with the casting apparatus, in order to transfer castings from one of the casting stations to the discharge station, wherein the automated transfer apparatus includes a Cartesian robot having:

a straight horizontal guide which extends above and in the vicinity of the casting stations and of the discharge station, and a robotic device which is mounted on a carriage movable along the guide and which can control the movements of the caster-gripping means in vertical planes parallel to one another and perpendicular to the guide, and wherein the robotic device comprises:

first translational means for bringing about translation of the gripping means along a first horizontal axis parallel to the horizontal guide, second translational means for bringing about translation of the gripping means along a first vertical axis, third translational means for bringing about translation of the gripping means along a transverse horizontal axis, first rotational means for bringing about rotation of the gripping means about a second vertical axis parallel to or coinciding with the first vertical axis, second rotational means for bringing about rotation of the gripping means about a second horizontal axis perpendicular to the second vertical axis, fourth translational means for bringing about or permitting translation of the gripping means alone a radial axis relative to the second horizontal axis, and actuator means for bringing opening and closure of the gripping means.

2. A casting system according to claim 1, wherein the fourth translational means can be controlled pneumatically in a manner such as to bring about an extension movement of the gripping means along the radial axis and to allow an opposite withdrawal movement of the gripping means along the same radial axis to take place substantially freely.

3. A casting system according to claim 1, comprising detector means for providing signals indicative of the quality of the castings gripped by the gripping means.

4. A casting system according to claim 3, wherein the means for detecting the quality of the castings are connected to a processing unit which is arranged to control the transfer apparatus in a manner such that:

if the signals indicative of the quality of the castings indicate that the castings gripped by the gripping means are complete, the apparatus deposits the castings in the discharge station, and if the signals indicative of the quality of the castings indicate that at least one of the castings gripped by the gripping means is not complete, the apparatus deposits the castings in a reject station.

5. A casting system according to claim 1, wherein the automated casting apparatus includes a Cartesian robot having:

a straight horizontal guide which extends above and in the vicinity of the casting stations and of the collection station, and a robotic device which is mounted on a carriage movable along the guide and which can control the movements of the casting ladle in vertical planes parallel to one another and perpendicular to the guide.

6. A casting system according to claim 5, wherein the straight horizontal guide of the casting apparatus extends above and in the vicinity of the casting stations and of the collection station.

7. A casting system according to claim 1, wherein the casting stations and the collection station are arranged substantially in alignment.

8. A casting system according to claim 1, wherein the collection station is disposed in an intermediate position between at least one of the casting stations and at least one other of the casting stations.

9. A casting system according to claim 1, wherein the collection station is disposed on a support means mounted so as to be rotatable about a third vertical axis and provided with at least two furnaces, the rotatable support means being rotated about the third vertical axis in order to present one of the furnaces in a collection position closer to the casting stations and one of the furnaces in a loading position farther from the casting stations.

10. A casting system according to claim 1, comprising electronic processing means for controlling the movements of the casting apparatus and of the transfer apparatus in coordinated manner.

* * * * *